United States Patent [19]

McKee

[11] Patent Number: 4,708,071

[45] Date of Patent: Nov. 24, 1987

[54] RING POSITIONING APPARATUS FOR SEWING MACHINE

[75] Inventor: Theodore F. McKee, Muscatine, Iowa

[73] Assignee: McKee Machinery Co., Inc., Muscatine, Iowa

[21] Appl. No.: 15,362

[22] Filed: Feb. 17, 1987

[51] Int. Cl.[4] ..... D05B 3/22

[52] U.S. Cl. ..... 112/113; 221/172

[58] Field of Search ..... 112/113, 104, 106, 110; 221/172, 171, 173; 198/394

[56] References Cited

U.S. PATENT DOCUMENTS

| | | | |
|---|---|---|---|
| 3,499,405 | 3/1970 | McKee et al. | 112/113 |
| 3,712,253 | 1/1973 | Asnes | 112/113 |
| 4,445,448 | 5/1984 | Fletcher | 112/113 |

*Primary Examiner*—H. Hampton Hunter

*Attorney, Agent, or Firm*—Allegretti, Newitt, Witcoff & McAndrews, Ltd.

[57] ABSTRACT

A sewing machine for securing annular rings to a curtain along a line is provided with feed chute means for receiving the annular rings and feeding them sequentially to a sewing position. The feed chute means comprises a chute body having a track defined therein, a retaining tab adjacent the open end of the track for at least partially blocking the track to prevent discharge of annular rings from the chute body, a spring biasing the retaining tab to a track block position and a slot defined in the chute body adjacent said open end.

In use, the retaining tab blocks the track, with an annular ring in position over the slot so that the sewing machine can secure the annular ring over the slot to the curtain. After the annular ring is sewn to the curtain, the curtain is pulled to cause the retaining tab to yield while the sewn annular ring is removed from the chute body and the next annular ring is advanced to the position over the slot for sewing to the curtain. The retaining tab is biased inwardly after the annular ring is removed from the chute to retain the next annular ring in desired position. The operation continues sequentially until the desired number of annular rings are sewn to the curtain.

8 Claims, 5 Drawing Figures

RING POSITIONING APPARATUS FOR SEWING MACHINE

BACKGROUND OF THE INVENTION

The present invention pertains to a feed chute for annular rings and more particularly, to a feed chute for feeding and positioning annular rings adapted to be sewn sequentially to a curtain.

Heretofore, curtains or drapes for covering a window or like opening, sometimes known as Roman shades, have had a series of annular rings sewn to a strip of fabric which is then sewn or otherwise bonded in a line to the curtain or drape. A string or rope is passed through the annular rings and affixed to the lower most ring. Pulling the string will cause opening of the curtain. The string may be secured to a support on the window frame adjacent the curtain to hold the curtain open. Release of the string will permit the curtain to fall by gravity and close the window opening. The present invention has to do with sewing the annular rings directly to the drape and more particularly for a feed chute associated with a sewing machine for automatically feeding and positioning the annular rings for sewing in line to the curtain.

A feed chute having some resemblance to that of the present invention is shown in U.S. Pat. No. 3,499,405 entitled "Loader and Aligner for Buttons". U.S. Pat. No. 3,499,405 relates to a loading mechanism for positioning and advancing buttons automatically by machine onto garments, such as shirts. The loading mechanism applies a button to the garment in position for sewing, and rotates the openings in the button for alignment with the sewing needle to properly sew the button to the garment.

The present invention is concerned with a sewing application different from that of U.S. Pat. No. 3,499,405. The loading mechanism of U.S. Pat. No. 3,499,405 is not useful for the intended application of sewing annular rings in line sequentially on a curtain.

An object of the present invention is to provide a relatively simple feed chute for feeding annular rings sequentially for sewing in line to a surface of a curtain.

Another object of the present invention is to provide a sewing machine with a fed chute having a body with a track therein for positioning annular rings in sewing position and permitting easy removal of the same annular ring from the feed chute after sewing, with another annular ring begin gravity fed to the sewing position as the sewn annular ring is removed from the track of the feed chute.

Other objects and advantages of the present invention will be made more apparent hereafter.

BRIEF DESCRIPTION OF THE DRAWING

There is shown in the attached drawing a presently preferred embodiment of the present invention, wherein, like numerals in the various views refer to like elements and wherein.

DETAILED DESCRIPTION OF THE PRESENT INVENTION

Figure 1:
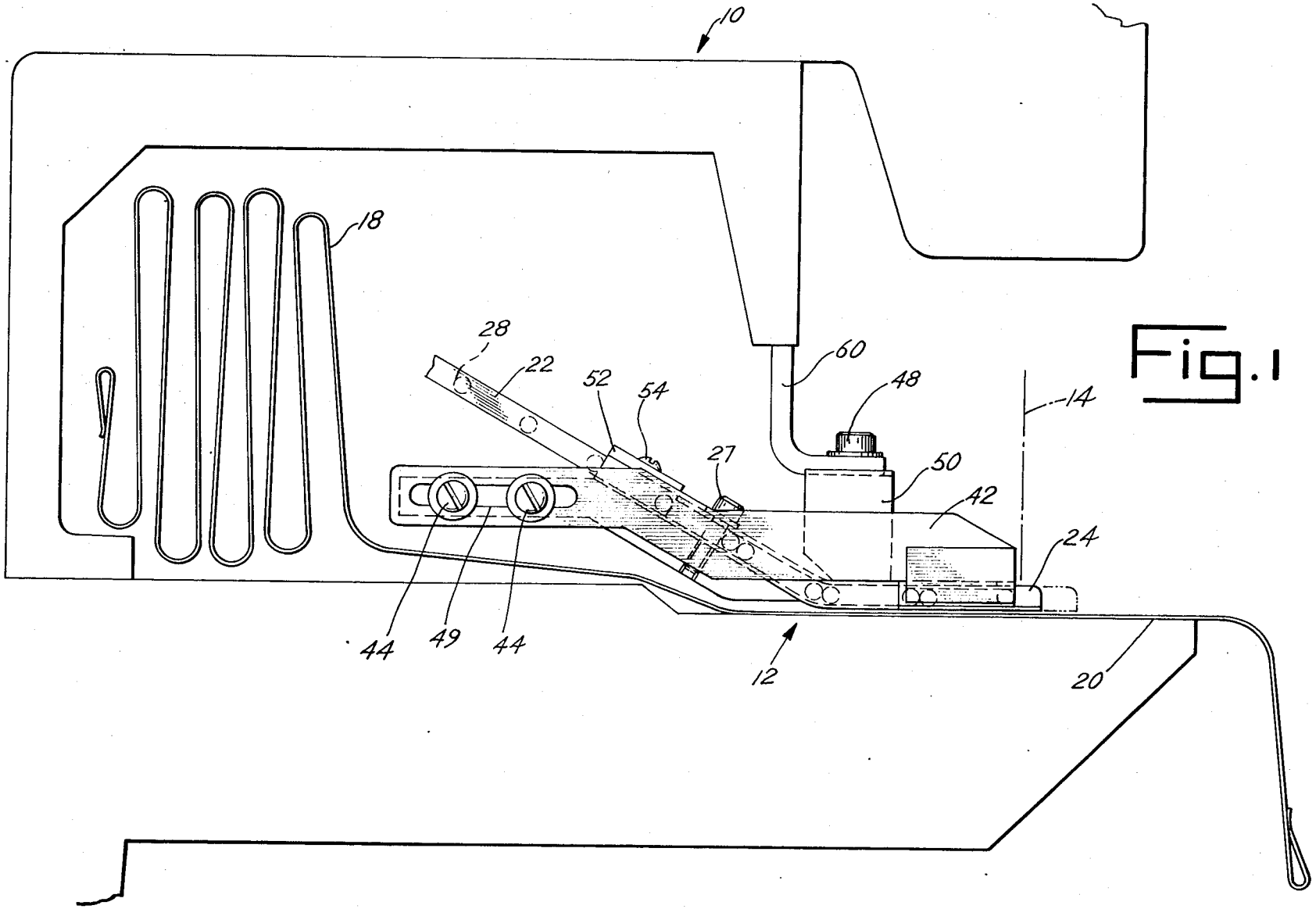
FIG. 1 is a side elevation view of a sewing machine embodying the novel feed chute mechanism of the present invention.

There is shown in FIG. 1 an outline of a sewing machine 10 with which the novel feed chute mechanism 12 of the present invention is intended to be used. One example of commercial sewing machine with which the feed chute mechanism 12 may be used is the Singer Model 269 device. The sewing machine 10 is provided with a needle (not shown) operable along the center line 14 to sew an annular ring to a curtain. As will be explained more fully hereafter, the feed chute mechanism 12 is moved from the rear clamp position shown in solid line in FIG. 1 to the front clamp portion indicated in dotted line in FIG. 1 to sew a selected annular ring to the curtain.

The curtain 18 to which the annular rings are to be sewn may be folded and positioned on the sewing machine 10 behind the feed chute mechanism 12. The lead edge of the curtain 18 is adapted to be passed between the feed chute mechanism 12 and the platform 20 of the sewing machine 10.

The feed chute mechanism 12 comprises a flexible feed chute 22 that is secured at one end to a hopper (not shown) for annular rings and at the other end to the chute body 24. The flexible feed chute 22 is oriented at an angle with respect to the top surface of the platform 20 to enhance gravity feed of annular rings in the flexible feed chute. Preferably, the angle is at least thirty (30) degrees. The flexible feed chute 22 takes the form of a flattened coil spring which provides jiggling movement in use to facilitate passage of annular rings through the flexible feed chute 22 to the chute body 24. The chute body 24 is in the form of an angle member, with the top portion secured to frame 25 by suitable fastening means, for example, screws 27.

With reference to FIGS. 2-5, there is better shown the feed chute mechanism 12. The chute body 24 has a track 26 defined on the top surface which receives annular rings 28 one at a time from the flexible feed chute 22. The track 26 is of a depth slightly greater than that of an annular ring 28. Further, the track 26 is of a width slightly greater than that of an annular ring 28. Chute covers 30, 32, which partially overlap the top of track 26, are secured to the chute body 24 a each side of the track 26 by suitable fastening means, for example, screws 36. The chute covers 30, 32 function to retain the annular rings 28 in the track 26, but they do no interfere with the passage of annular rings 28 along track 26.

Extending into the track 26 from one side adjacent to the open end of the track 26 is a retaining tab 38, which functions to stop and position the first annular ring 28 adjacent the open end. The first annular ring 28 is positioned over slot or recess 40, which is preferably of a longitudinal length greater than that of the thickness of the annular ring 28. The retaining tab 38 is secured to spring means 42, which biases the retaining tab 38 inwardly into the track 26 to stop an annular ring 28 and position a segment thereof over the slot 40 in position to be sewn to a curtain.

The spring means 42 comprises a resilient plate or plate spring, which is secured to the frame 25 of the feed chute mechanism 12 by suitable fastening means, for example, screws 44. The plate spring 42 is adjustably secured to the frame 25 by the fastening means 44 extending through slot 49. The screws 44 are loosened to permit adjustment and then tightened to retain the plate spring 42 in adjusted position. Adjustment of the plate spring 42 longitudinally of the track 26 provides for proper adjustment of the retaining tab 38 so as to desirably position the first annular ring 28 in track 26. It will be understood that while an elongated opening or slot 49 is preferred, adjustment can be accomplished by a plurality of openings in the plate spring 42.

Figure 2:
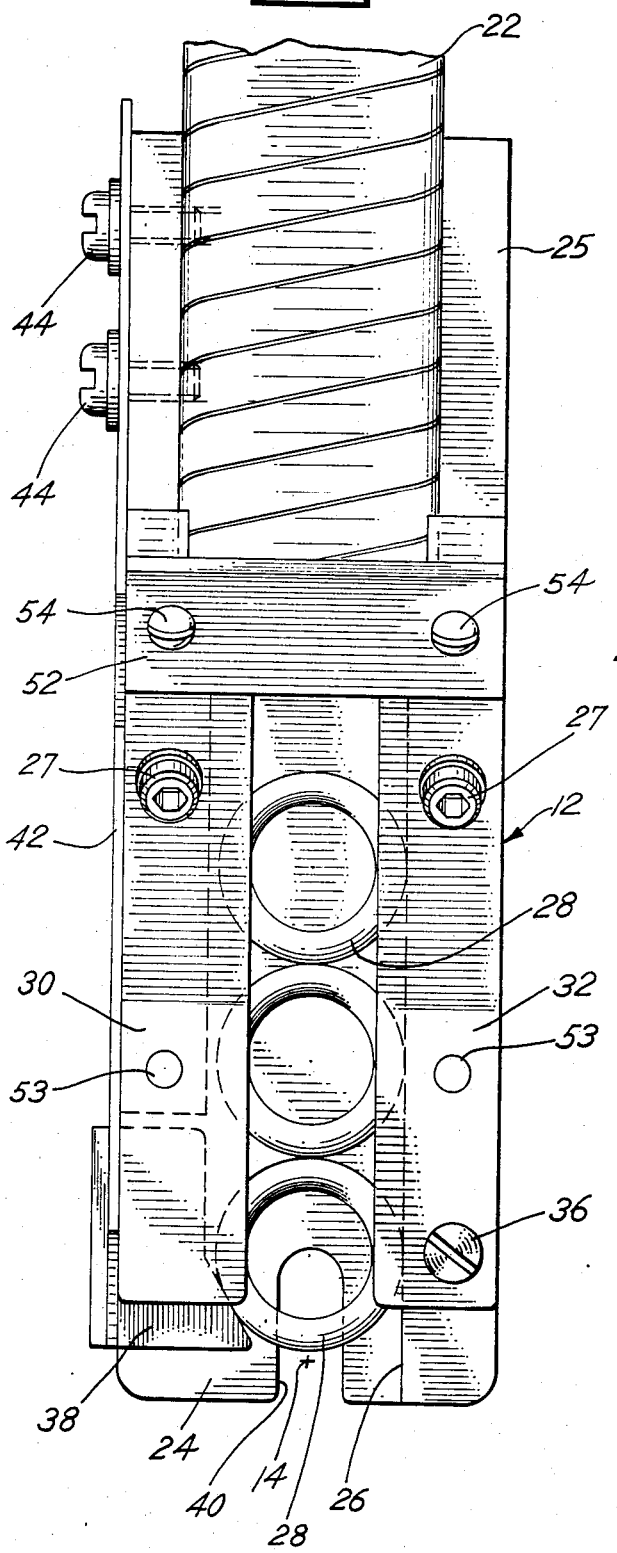
FIG. 2 is a plan view of the feed chute mechanism, with the mounting block omitted.
Figure 3:
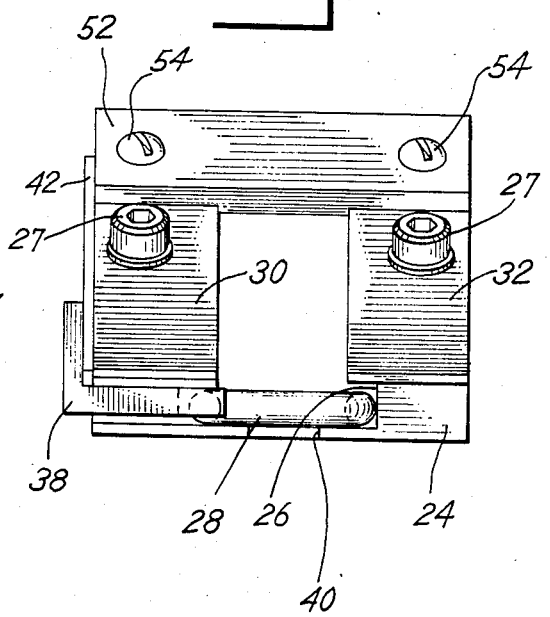
FIG. 3 is a front view of the feed chute mechanism, with the mounting block omitted.
Figure 4:
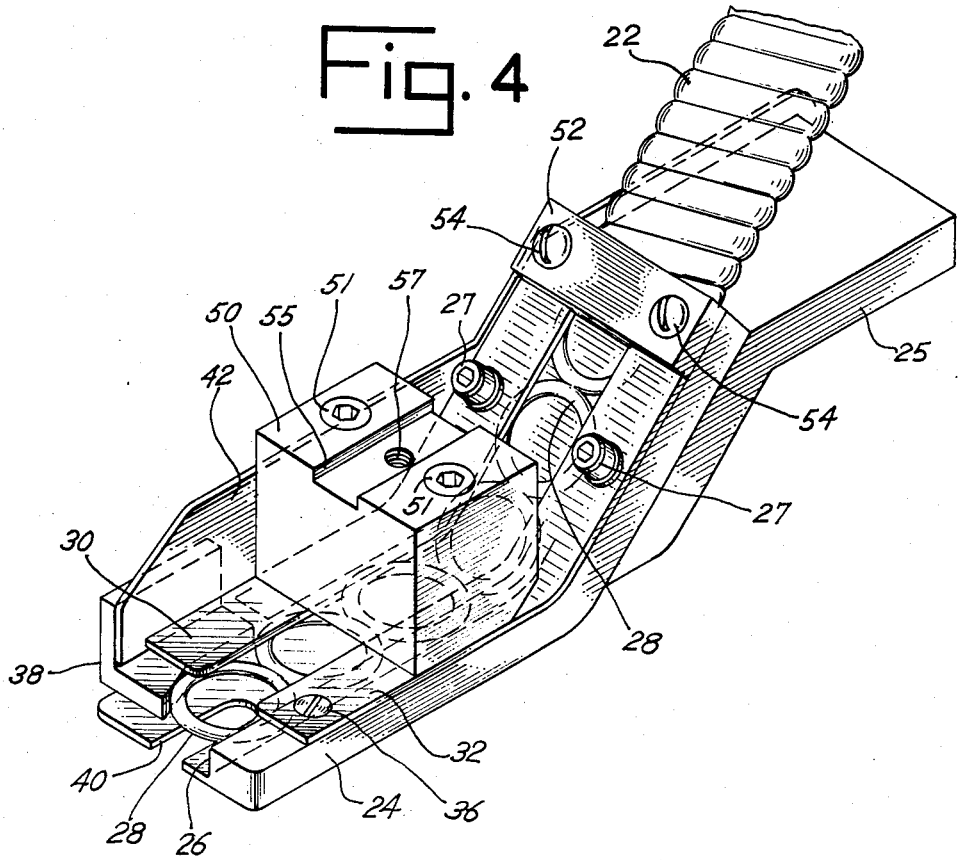
FIG. 4 is a right front perspective view of the feed chute mechanism.
Figure 5:
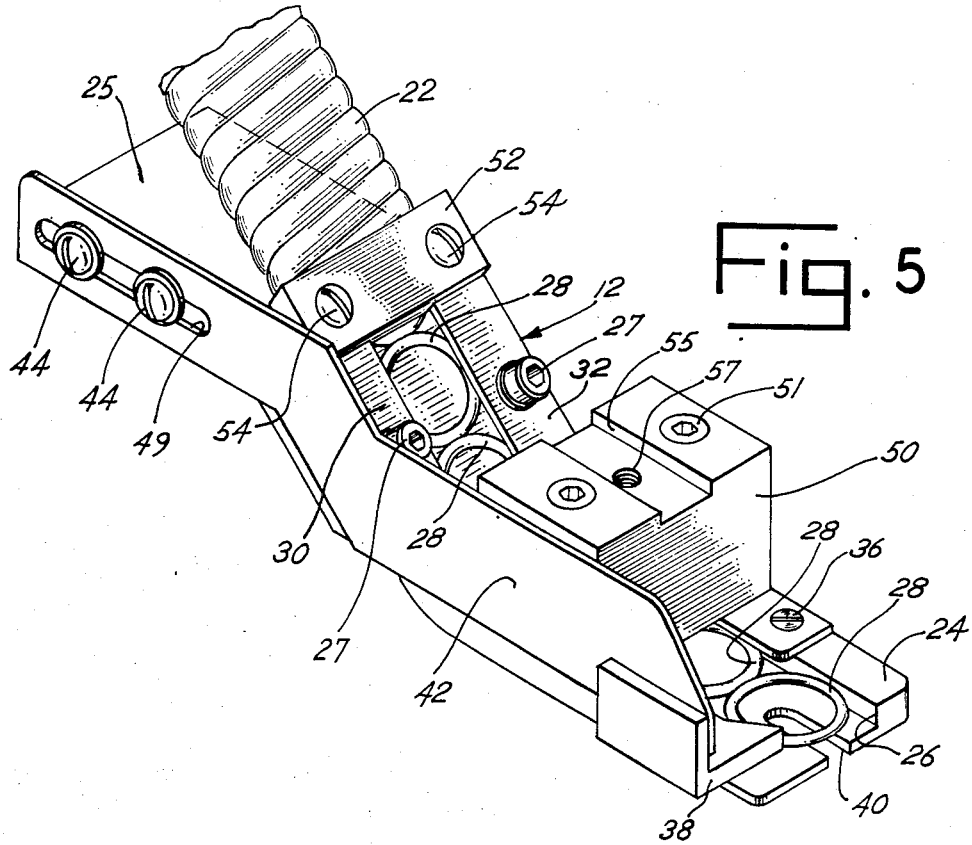
FIG. 5 is a left front perspective view of the feed chute mechanism.

The chute body 24 is secured to mount 60 on the sewing machine 10 by suitable fastening means, for example, screw 48, which extends into mounting block 50. The mounting block 50 is in turn secured to the chute body by screws 51. The screws 51 extend into threaded openings 53 in the chute body (FIG. 2). The mount 60 has a portion which extends into the groove 55 (FIGS. 4 and 5) in the top of mounting block 60. Screw 48 extends into the threaded opening 57 in the top of mounting block 50 (FIGS. 4 and 5). This arrangement permits the feed chute mechanism 12 to be positioned in close relationship with the platform 20 and to be moved fore and aft relative to the center line 14 of the needle and along the longitudial center line of track 25 and over slot 40 in the chute body 24 in order to sew an annular ring 28 to curtain 18.

It is noted that the flexible feed chute 22 is secured to the chute body 24 by retaining plate 52 and fastening means, which, as shown, comprise screws 54. The outlet from the flexible feed chute 22 is aligned with the inlet to track 26 in chute body 24.

In use, annular rings 28 are fed into the flexible feed chute 22 from the hopper (not shown) and gravity fed to track 26, with the first annular ring 28 in the track 26 engaged by the retaining tab 38 to position the annular ring adjacent the open end of the track 26 with the annular ring 28 over the slot 40. The annular rings 28 abut one another within the flexible feed chute 22 and the track 26. The curtain 18 is folded as shown in FIG. 1, with the front edge of the curtain positioned between the chute body 24 and the platform 20.

The sewing machine 10 is actuated, the curtain 18 is clamped in sewing position and the feed chute mechanism 12 is moved fore and aft, i.e., from the solid line position to the dotted line position shown in FIG. 1, to secure the first annular ring 28 to the surface of the curtain 18, which surface would not normally be viewed when the curtain is in use. The needle (not shwon) is adapted to work up and down on center line 14 (FIG. 1). A multi-filament thread may be used which has fibers matching those of the exterior surface of the crutain that is normally viewed so that the annular rings 28 may be relatively unobtrusively sewn to the curtain 18. After the first annular ring 28 is secured to the curtain, the curtain is released by the sewing machine clamp so that it can be advanced or pulled forwardly. The retaining ring 38 yields to permit the first annular ring 28 to be pulled from the track 26. The annular rings 28 are gravity fed in the track 26, with the retaining tab 38 being biased inwardly by plate spring 42 after the first annular ring 28 is withdrawn to block the track 26 and position the next annular ring 28 adjacent the open end, with a portion thereof over the slot 40. It is seen that the annular rings 28 are advanced sequentially as the first and then succeeding annular rings 28 are sewn to the curtain 18 and pulled from the track 26.

There has been provided by the present invention a unique feed chute means having a track formed therein for receiving annular rings sequentially and permitting discharge of some one at a time from the open end of the track. A spring-biased retaining tab on the feed chute means at least partially blocks the track to position the first annular ring adjacent the open end of the track in position to be sewn onto a curtain. A slot is formed in the feed chute means adjacent the open end of the track and beneath a portion of the annular ring. After the first annular ring in the track is sewn to the curtain, the curtain is pulled to cause the retaining tab to yield and the next annular ring is advanced by gravity feed to a position over the slot adjacent the open end of the track. The annular rings in the track may be sewn sequentially to the curtain in a line.

While I have shown a presently preferred embodiment of the invention, it will be apparent to those skilled in the art that it may be otherwise embodied within the scope of the appended claims.

What is claimed:

1. For use with a sewing machine for securing annular rings to a curtain, feed chute means comprising a chute body having a track formed therein for receiving annular rings sequentially and permitting discharge of same one at a time from an open end, a retaining tab adjacent the open end for at least partially blocking the track to prevent discharge of annular rings from the chute body, spring means for biasing the retaining tab to a track blocking position, and a slot defined in the chute body adjacent said open end, whereby, the retaining tab at least partially blocks the track to position an annular ring at least partially over the slot so that the sewing machine can secure the annular ring over the slot to the curtain and pulling the curtain will cause the retaining tab to yield while the sewn annular ring is advanced to a position over the slot.

2. Feed chute means as in claim 1 including chute covers at least partially covering the track to help retain annular rings in the track.

3. Feed chute means as in claim 1 including annular ring supply means secured to the chute body for supplying annular rings to the chute body.

4. Feed chute means as in claim 3 wherein the annular ring means comprises a flexible feed member.

5. A feed chute as in claim 1 wherein the spring means comprises a resilient plate secured to the chute body, said retaining tab being secured to the resilient plate, said resilient plate normally urging the retaining tab into an annular ring stop position and said resilient plate yielding when a sewn annular ring is pulled from the track.

6. Feed chute means as in claim 4 including a retaining plate for connecting an end of the flexible feed member to the chute body.

7. Feed chute means as in claim 1 including means for adjustably supporting the retaining tab relative to the open end of the chute body.

8. Feed chute means as in claim 7 wherein the spring means comprises a resilient plate secured to the chute body and the means for adjustably supporting the retaining tab includes an elongated opening in the resilient plate and fastening means for securing the resilient plate to the chute body, whereby the fastening means are loosened to permit the resilient plate to be moved to position the retaining tab as desired and then the fastening means are tightened to secure the resilient plate and retaining tab in desired adjusted position.

* * * * *